US006881443B2

(12) United States Patent
Baltensperger

(10) Patent No.: US 6,881,443 B2
(45) Date of Patent: Apr. 19, 2005

(54) ADHESIVE APPLICATION STATION FOR PRINTED PRODUCTS

(75) Inventor: Walter Baltensperger, Baar (CH)

(73) Assignee: Sogno AG, Baar (CH)

( * ) Notice: Subject to any disclaimer, the term of this patent is extended or adjusted under 35 U.S.C. 154(b) by 375 days.

(21) Appl. No.: 09/899,681

(22) Filed: Jul. 5, 2001

(65) Prior Publication Data

US 2002/0053406 A1 May 9, 2002

(30) Foreign Application Priority Data

Jul. 10, 2000 (CH) ..... 1356/00

(51) Int. Cl.[7] ..... B05D 5/10

(52) U.S. Cl. ..... 427/208.6; 118/411; 427/286; 156/578

(58) Field of Search ..... 427/284–286, 427/288, 207.1, 208.4, 208.6, 208.2; 222/37, 33, 517; 412/37, 33, 8; 118/429, 690, 411, 666, 692, 675–676, 712, 704, 702; 239/569, 337, 320, 581.1, 537, 340, 538, 97, 69, 436, 437, 443, 446, 447, 568; 156/578, 556–572, 308.4, 390, 908

(56) References Cited

U.S. PATENT DOCUMENTS

| | | | | |
|---|---|---|---|---|
| 2,660,148 A | | 11/1953 | Fogg | |
| 3,642,181 A | * | 2/1972 | Thomas | |
| 3,811,405 A | * | 5/1974 | Baker et al. | 118/675 |
| 3,826,224 A | * | 7/1974 | Baker et al. | 118/685 |
| 4,175,558 A | * | 11/1979 | Hess et al. | |
| 4,179,325 A | * | 12/1979 | Staats et al. | 156/498 |
| 5,129,772 A | | 7/1992 | Slautterback | |
| 5,685,911 A | | 11/1997 | Raterman et al. | |

FOREIGN PATENT DOCUMENTS

| | | |
|---|---|---|
| DE | 41 21 792 | 1/1993 |
| DE | 41 21 792 A1 | 1/1993 |
| GB | 447219 | 5/1936 |
| GB | 2 141 644 | 1/1985 |

* cited by examiner

*Primary Examiner*—Brenda Adele Lamb
(74) *Attorney, Agent, or Firm*—Bachman & LaPointe, P.C.

(57) ABSTRACT

The adhesive application station (14) for binding stacked printed products (10) by means of a liquid or liquefiable adhesive (52) comprises an application station (14) with an adhesive discharge system (15). This system consists substantially of an application head (12) for the adhesive (52) with a slip surface (16) for the printed products (10), and an application nozzle (42) extending over the entire width (g) of the slip surface (16) with at least one outlet opening (20) for the adhesive, an adhesive reservoir (50) and means for generating a pressure on adhesive application. The adhesive discharge system (15) also comprises immediately adjacent to the outlet opening(s) (20), a metering device (44, 45) which can be sealed manually and/or electronically controlled by an actuator (130). This metering device (44, 45) forms with the adhesive reservoir (50) and an integral accumulator (54) a pressure compensation system. In the accumulator (54) are formed means acting directly on the adhesive reservoir (50) arranged in or below the application head (12) whereby after each adhesive discharge an automatic pressure compensation is guaranteed. Operating interruptions from clogging can be prevented as all the adhesive applied (52) is passed from a reservoir to the outlet opening (s) (20) without contact with air.

10 Claims, 6 Drawing Sheets

ADHESIVE APPLICATION STATION FOR PRINTED PRODUCTS

BACKGROUND OF THE INVENTION

The invention concerns an adhesive application station for binding stacked printed products by means of a liquid or liquefiable adhesive and a process for its operation, where said application station comprises an adhesive discharge system which substantially consists of an application head for the adhesive with a slip surface for the printed products and an application nozzle extending over the entire width of the slip surface with at least one outlet opening for the adhesive, an adhesive reservoir and means for generating a pressure for adhesive application.

For production of books, magazines, brochures etc. printed products of all types are first stacked and fixed in a holder. Then the so-called spine is milled flat and simultaneously roughened. In this way, the subsequently applied adhesive can adhere better. Insufficient adhesion of the adhesive leads to poor binding quality, the bound printed products fall apart in use or individual leaves become detached. The applied adhesive layer must however not only firmly bind each individual page but also be resilient to allow easy leaving through the bound printed products.

The application of adhesive with a brush or equivalent means as practiced originally was simplified as developments advanced so that the prepared spine of a stack could be drawn over at least one roller immersed in an adhesive bath. This open system has however the disadvantage that, for example in the case of a moisture-reactive polyurethane adhesive, the physical and chemical properties could change under the effects of air and heat. The same or similar problems can occur in all known adhesives which are used as cold adhesives, hot adhesives or hot melts (thermoplastic adhesives). Advantageously, economical and ecological considerations have led for example to watery polyurethane dispersions, known in brief as PU dispersions. The term PU indicates a group of high molecular materials which are produced by poly-addition of di-isocyanates and bi- or multi-functional hydroxyl compounds. In their molecules the basic modules are linked by the urethane group (—NH—COO—). Depending on the chemical nature of the original compounds used, polyurethanes are obtained with linear, branched or cross-linked macro-molecules. Linear polyurethanes are thermoplastic substances which have multiple applications. Here we are interested only in cross-linked elastomer polyurethanes which are suitable as resilient, water—and heat-resistant adhesives.

Adhesive application stations are known which work with slot nozzles. The prepared spine of a stack of printed products is drawn between two stops over a slip surface with an outlet slot for the adhesive. The slot nozzle discharges adhesive during this short period.

Adhesives used in book binding are as has been stated often reactive, they react to relative air humidity. If there is no nozzle seal, the area between the metering device and the outlet opening of the nozzle is open, the nozzle is closed for example by hand with a metal plate. This system is, however, laborious and time-consuming. In addition, on starting and stopping of the adhesive application station the adhesive is not so well controlled.

A further known adhesive application station has a seal on the inside of the device. As a result control on starting and stopping of the adhesive application is adequate. However, between the seal and the nozzle outlet opening there is still an open adhesive system which has a tendency to clog and hence cause operating interruptions.

GB, A 447219 describes an adhesive device for book binding which simplifies the usual adhesive application with an application roller partly immersed in a liquid adhesive compound. A round tube with a slot, and which is closed at the end, is introduced tightly but rotatably in a sleeve which is also closed at the end, and which has outlet openings in the area of said slot. Arranged over the sleeve is a movable cover plate with a slip surface and passage openings over which cover plate the book spines are drawn for gluing. By twisting or moving, the outlet openings can be at least partly overlaid and opened for the outflow of the adhesive pressed into the sleeve in the axial direction.

In all details U.S. Pat. No. 2,660,148 shows a book binding machine with an adhesive extruder documenting the former state of the art. The paper stack prepared for binding is suspended between two clamping plates in the area of a roller-like, centrally controlled application device, where a distance is maintained from the central block. In the working cycle the extruder sprays adhesive onto the book spines by way of outlet openings. The adhesive-coated book spines are then passed over a measuring roller which corrects the layer thickness if necessary. Surplus adhesive is collected in a trough and returned to the adhesive reservoir, or recycled. The device as such is extremely complicated and, like GB, A 447219, can scarcely constitute a foundation for modern plants in view of its great age.

It is the principle object of the present invention to provide an adhesive application station for binding stacked printed products of the type described initially which eliminates the problems of clogged nozzle outlet openings.

SUMMARY OF THE INVENTION

The foregoing object is achieved wherein an adhesive discharge system comprises immediately adjacent to the outlet opening(s), a metering device which can be sealed manually and/or electronically controlled by an actuator and which, with the adhesive reservoir formed as a pressure chamber and an integral accumulator, forms a pressure compensation system, where in the accumulator are formed means acting directly on the adhesive reservoir arranged in or below the application head, whereby after each adhesive discharge an automatic pressure compensation is guaranteed.

In the direction of running of the printed products, on both sides of the slip surface is arranged a stop for these still separate sheets. The outlet opening(s) for the adhesive must be covered so well at the sides that no adhesive strings can occur on the bound stack of printed products.

An application nozzle is formed in co-operation between the adhesive outlet opening(s) and the metering device arranged immediately below this. The metering device in turn limits the adhesive reservoir formed as a pressure compensation system which is arranged in or below the application head and directly connected with an adhesive dispenser, in particular a pressure vessel. This has the advantage not previously achieved that all the adhesive from the reservoir, preferably formed as a pressure vessel, to the outlet opening(s) in the application head never comes into contact with air, which prevents the chemical and physical changes mentioned above. The use of a pressure vessel in particular has the further advantage that only the quantity required is melted. Totally fresh adhesive is always available.

To generate the necessary pressure in the adhesive reservoir, a directly acting plunger of a pressure cylinder is provided in a pneumatic accumulator. The necessary pressure can, however, also be generated hydraulically, electromagnetically with a linear motor, mechanically with a spindle, or in other known ways.

The pressure can be, and is, modified in relation to the machine speed so that all parameters are optimally matched.

The metering device and the inside of the outlet opening (s) to the slip surface form a preferably tight-fit seal. This can be completely closed and thus prevent not only the passage of adhesive but also the penetration of air into the compensation system, which—as been shown above—is of essential importance.

In the working position the outlet opening(s) of the slip surface and those of the metering device are matched to each other so that the adhesive can flow out unhindered. In a special embodiment the outlet cross-section of the outlet opening(s) in the slip surface is adjusted in steps or continuously so the outlet opening(s) is(are) partly still covered by the metering device. In other words in this case the metering device is not fully open.

The depth of the outlet opening(s) of the slip surface—depending on the mechanical stability of the adhesive application system—lies in the order of maximum a few millimeters, preferably 0.1–5 mm, in particular 0.5–2 mm.

Suitably, the outlet opening(s) consist(s) of a narrow outlet slot extending preferably over the entire width of the slip surface for the printed products. In practice the metering device is suitably formed as a rotatable shaft with a slot extending in the radial direction. Instead of a slot, however, several corresponding linear recessed radial bores can be formed. In this case the seal can be achieved by twisting and/or longitudinally displacing the metering shaft.

Also, the metering device in the application head can merely be longitudinally displaceable. In this case a central longitudinal channel and bores running transverse to the longitudinal direction can be provided, cut out longitudinally at a distance apart greater than their diameter. In this case a corresponding number of outlet openings must be cut out in the slip surface. The longitudinal bores of the metering device and those of the slip surface must be able to be brought into complete alignment. By displacing the metering device longitudinally, the adhesive supply can be closed air-tight, partly or fully opened.

When a hot adhesive, in particular a hot melt, is used, irrespective of the design of the metering device, at least one heating cartridge which is suitably sensor-controlled can be arranged in the adhesive reservoir. The adhesive is held at the temperature necessary for optimum viscosity by means of a temperature sensor.

After each discharge of adhesive through the outlet slot, an automatic pressure compensation known in itself takes place which is integrated in the system with the pneumatic or mechanical accumulator.

As a stack always contains the same number of printed products which are cut from the same print carrier web, the width of the slip surface with the adhesive outlet slot can be set precisely. In practice however deviations occur in stack height which leads to undesirable adhesive strings. From experience, however, the tolerance ranges are very narrow. Even in large stacks they are normally maximum approximately ±0.5 mm, in exceptional cases maximum ±1 mm.

The most economic solution to compensate for the uneven stack heights is to form an application head with one usually fixed stop and one stop resilient within the tolerance range for the stacked printed products to be bound. The advance of the stack is preferably facilitated in that the guide surfaces in the insertion direction taper to the area of the slot nozzle. This can be achieved in the form of chamfers but also by suitably curved surfaces.

The stop which is resilient in the slot direction—below, for the sake of simplicity, reference is made only to the slot solution for adhesive outlet which is by far the most common in practice—with a guide surface can be structured according to various variants irrespective of whether a resilient stop and a fixed stop are formed or whether both stops are resilient:

According to a first variant, a guided carriage, resilient as a whole, can be moved on a nozzle block of the application head in the direction of the outlet slot and with its guide surface form a resilient stop.

In a further variant a suitably cylindrical roller which is movable in the slot direction in a positionable holder, and with an axis perpendicular to the slip surface, can be the guide surface.

In a still further variant a slide guided in the slot direction is formed with a correspondingly shaped front guide surface. The slide is movable in the direction of the guide slot, for example against the resistance of a spring or against a pneumatic pressure, and arranged in a precisely positionable retainer.

According to a last variant mentioned here, a leaf spring is arranged at the front on a positionable holder already mentioned, so that it forms a guide surface deformable resiliently by approximately ±1 mm in the slot direction. Various types of leaf spring are suitable which simultaneously cover the outlet slot in the tolerance range of approximately 1 mm.

As already indicated, the movable stop is automatically returnable preferably by spring force. In the same way the movable stop can be pneumatically sprung. As the necessary tolerance range as has been stated is very narrow, and usually only amounts to fractions of a millimeter, the movable stop must be positionable precisely.

As the stops with the side guide surfaces, except for the variant with a leaf spring, can be formed more or less solid with regard to the said adhesive strings, these are in principle no problem. A short insert or thickening in a plate spring can also fulfill this purpose.

Furthermore, the movable stop lying on the adhesive outlet slot must cover this so well that no adhesive strings form on the bound stack of printed products. As the stops with the side guide surfaces, except for the variant with a leaf spring, can be formed more or less solid, this is in principle no problem. A short insert or thickening in a plate spring can also fulfill this purpose.

Said slot nozzle is formed by co-operation between the adhesive outlet slot with a metering shaft arranged tightly immediately below, which for example has a longitudinal through slot.

All stops with the guide surfaces for the stack of printed products to be bound preferably consist of wear-resistant polished material as the print media drawn over these, in particular paper, acts as an abrasive cloth. Special steels, hard metals, ceramic materials or cermets are suitable materials for guide surfaces.

With reference to the process, the task is solved according to the invention in that all the adhesive applied is passed from the reservoir to the outlet opening(s) without contact with the air.

The lack of contact with the air in particular prevents operating interruptions due to clogging.

BRIEF DESCRIPTION OF THE DRAWINGS

The invention is explained in more detail using the examplary embodiments shown in the drawing, which are the subject of dependent claims. These show diagrammatically:

DETAILED DESCRIPTION OF THE PREFERRED EMBODIMENT(S)

Figure 1:
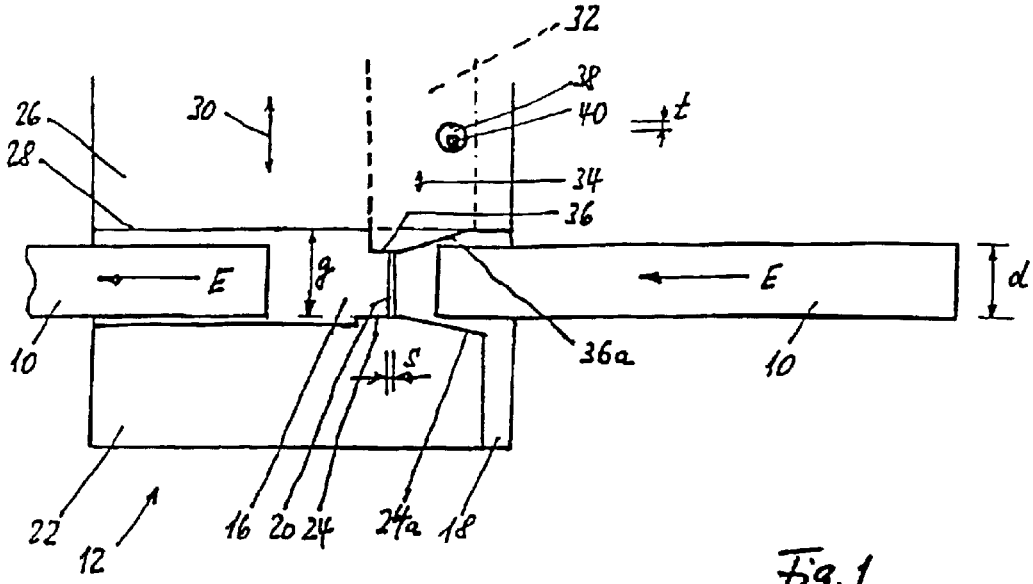
FIG. 1 is a principle sketch of the binding area of an application head of an adhesive application system in a top view.
Figure 2:
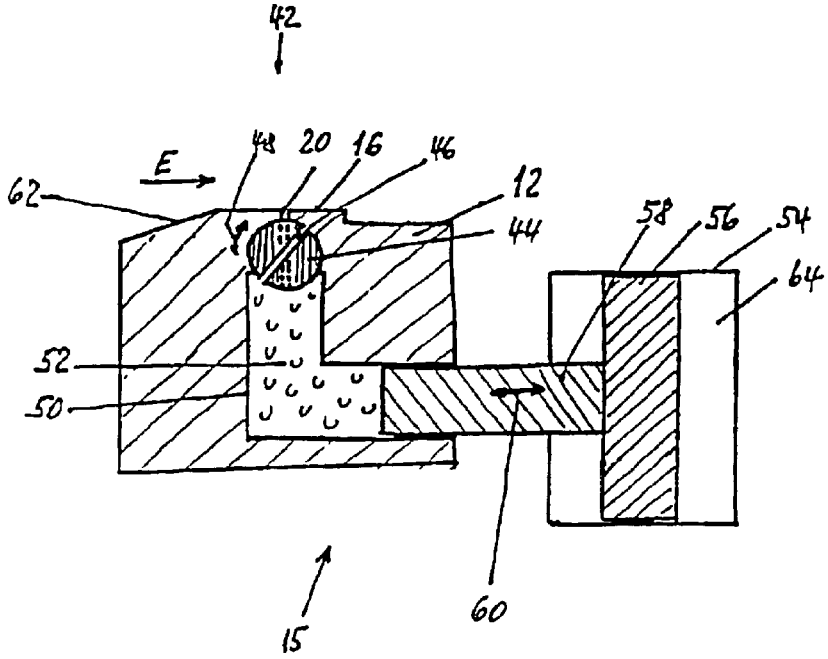
FIG. 2 is a principle sketch of a pressure system with pressure compensation in cross-section.
Figure 3:
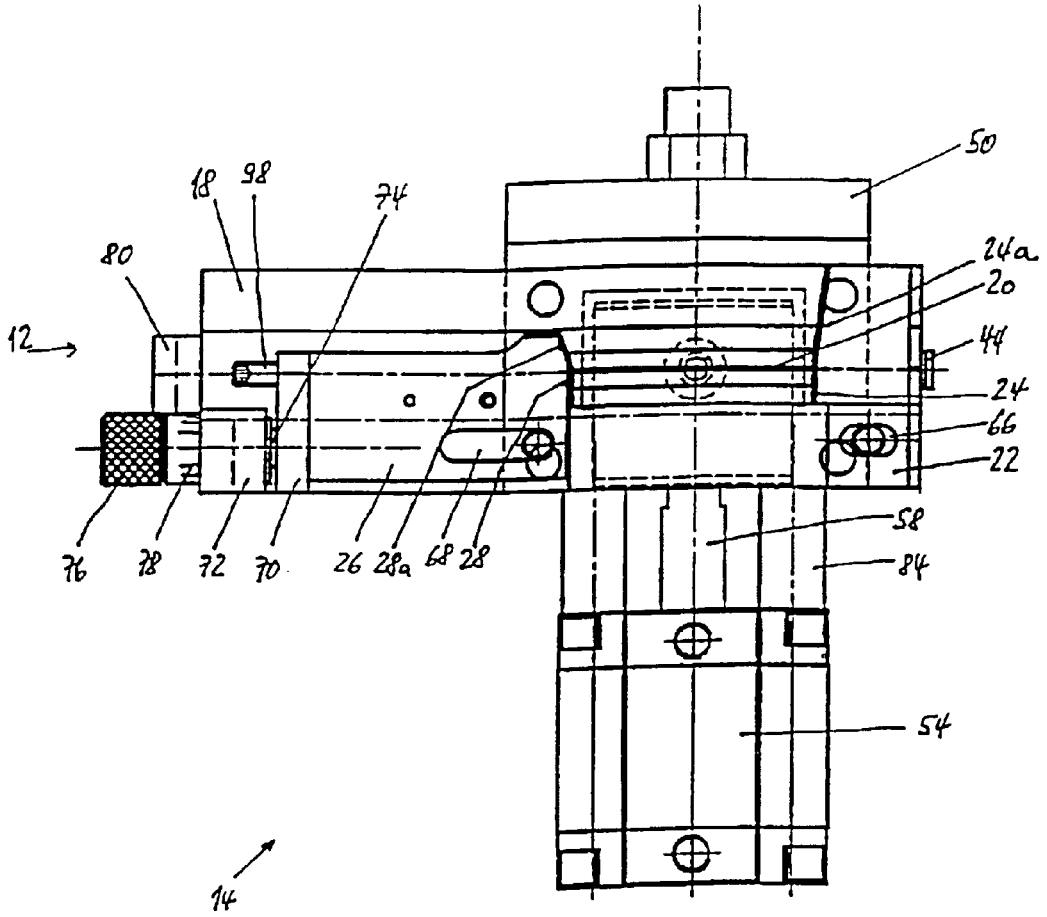
FIG. 3 is a top view onto an adhesive application station.
Figure 4:
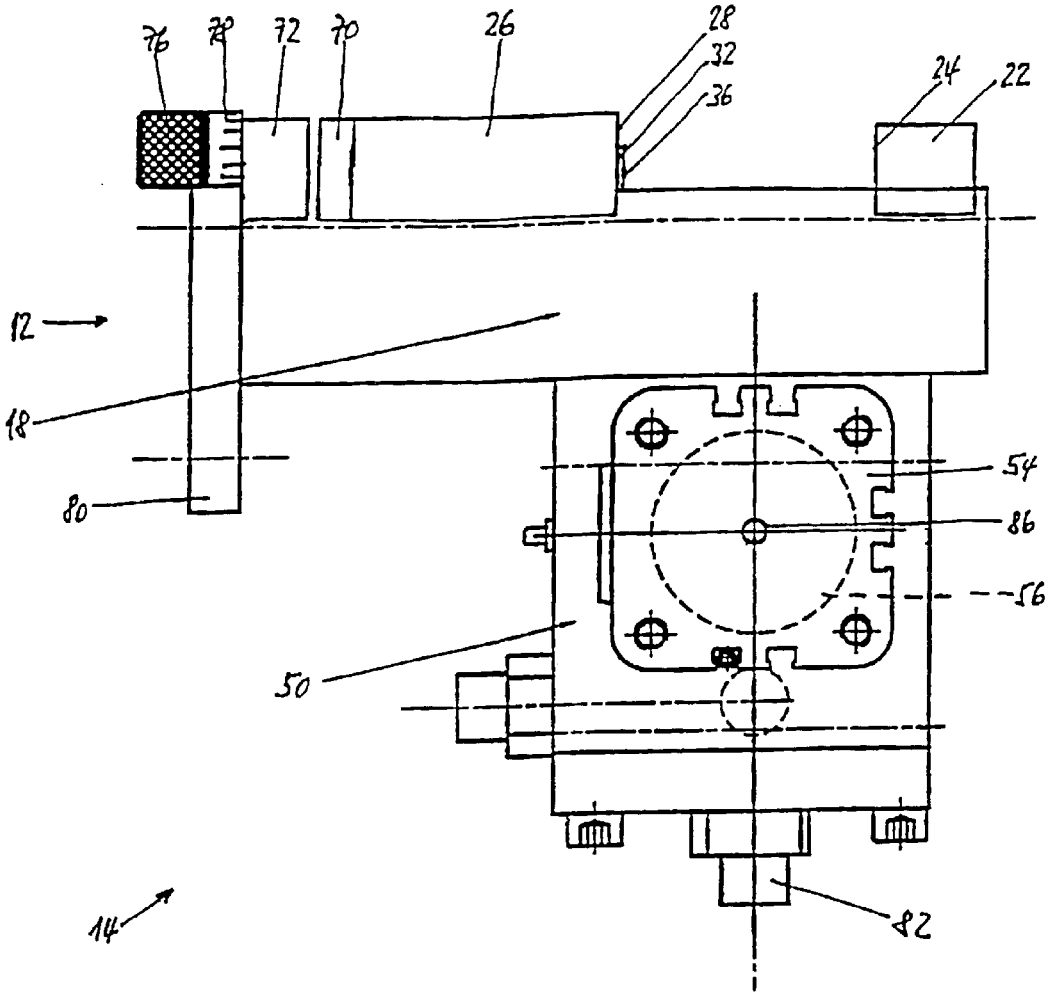
FIG. 4 is a front view of FIG. 3.
Figure 5:
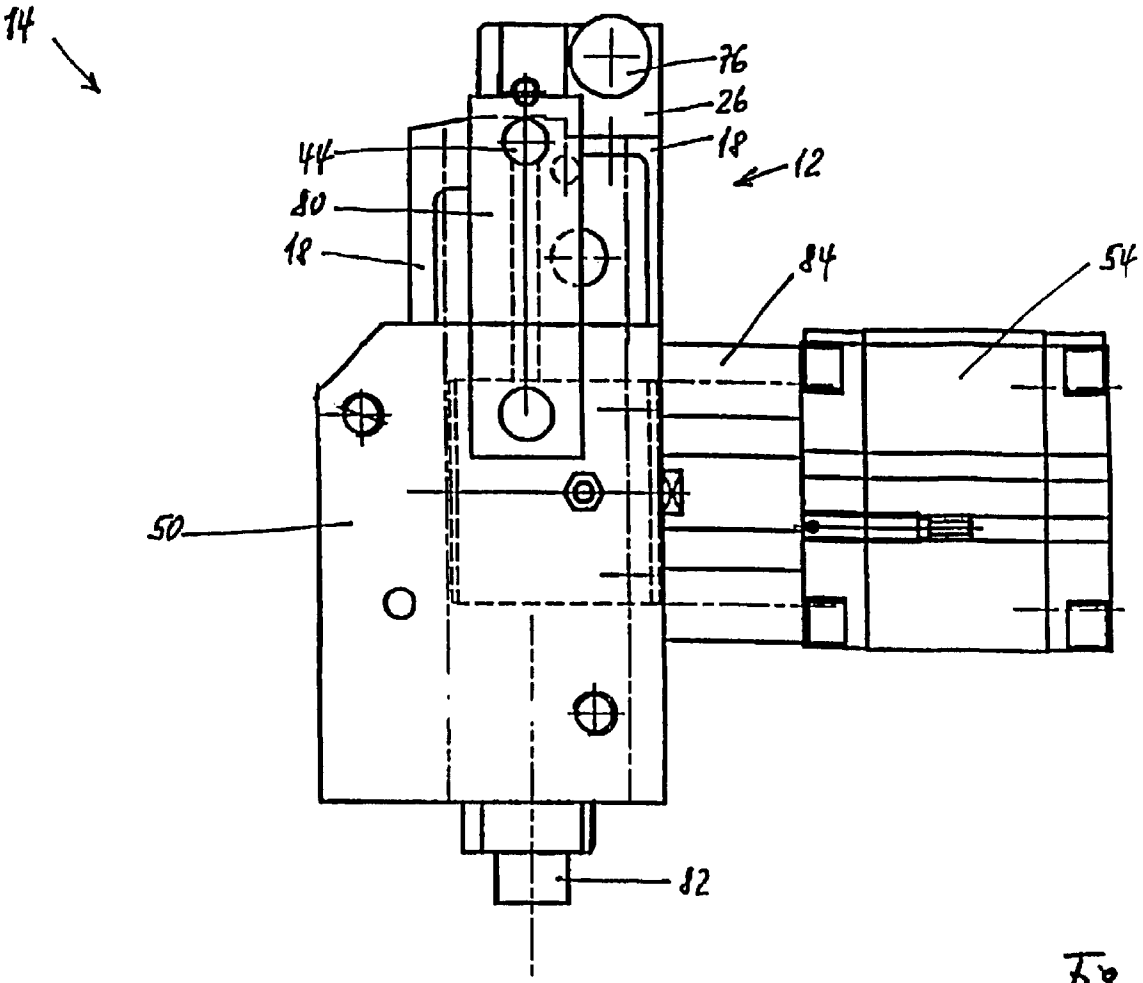
FIG. 5 is a side view of FIG. 3 (from the left)

FIG. 1 shows a preferred design example of the binding of stacked printed products 10 on an application head 12 of an adhesive application station 14 (FIGS. 3 to 5). A slip surface 16 of a nozzle block 18 of the application head 12 has an outlet slot 20 running in the longitudinal direction for an adhesive 52 (FIG. 2), forming an application edge. In the present case the slot width s of the outlet slot 20 is approximately 0.2 mm. This slot width is not normally modifiable but, however, in practice can be adjusted by precise turning of the metering shaft (44 in FIG. 2).

The slip surface 16 is bordered at the side by a fixed stop 22 with a first guide surface 24, including a deflector 24*a*, and a retainer 26 with a second guide surface 28, including a deflector 28*a*, for a printed product 10. The retainer 26 can be moved and positioned precisely in the direction of the double arrow 30 which runs parallel to the outlet slot 20. In the present case the retainer 26 guides a slide 32 which can be pressed into the retainer 26 against a spring force within a close tolerance range t in the direction of the double arrow 34 also running parallel to the outlet slot 20. The slide 32 has a third guide surface 36 for stacked printed products 10 also with a deflector 36*a*. Both this third guide surface 36 and the first guide surface 24 are angled and expand as deflectors 24*a*, 36*a* against the introduction device E for stacked printed products 10. The close tolerance range t for the slide 32 which can be returned by spring force is limited by a bore 38 in the retainer 26 and a bolt 40 projecting into this bore from the slide 32.

To bind stacked printed products, first the retainer 26 with slide 32 is positioned corresponding to the minimum thickness d of the stacked printed products 10, and for example adjusted with a screw. For a tolerance range of for example 0.5 mm for the thickness d of the stacked printed products, the width g of the slip surface 16 is set at distance d+t, assuming that the slide 32 is pressed flush against the second guide surface 28 at maximum tolerance t. The slide 32 is pressed in when the stacked printed products 10 are introduced, when they are pushed along deflectors 24*a*, 36*a* of the first and third guide surfaces 24, 26. When reaching the outlet slot 20 the adhesive application begins mechanically, electronically or sensor-controlled and ends when the printed product 10 leaves the area of the outlet slot 20.

Both the retainer 26 and the slide 32 seal the outlet slot 20 when and where they lie on the sliding surface 16.

When the stacked printed products 10 are guided over the outlet slot 20, they are pressed by the slide 32 onto the first side guide surface 24. The second guide surface 28 does not in this case act as such, the stacked printed products 10 slide along the third guide surface 36 with deflector 36*a*. On binding according to FIG. 1, differences with regard to thickness d of the stacked printed products 10 both within the same stack and from stack to stack, are compensated automatically, adhesive cannot be discharged next to the printed products 10, thus avoiding not only a loss of adhesive but also the formation of undesirable adhesive strings.

According to a variant not shown, the slide 32 can be omitted and the retainer 26 itself formed as a movable stop resilient in the tolerance range. In this case the stacked printed products 10 slide along the second guide surface 28 with deflector.

The general function description of FIG. 1 is supplemented by FIG. 2 essential to the invention and drawn from the opposite side. In the application head 12 is sketched a slot nozzle 42 which comprises the outlet slot 20 shown in FIG. 1 and a metering shaft 44 which is guided in a bore of the application head 12 and has a longitudinal slot 46. This extends over the length of the outlet slot 20 of the slip surface 16.

Below the metering shaft 44, which is rotatable in the direction of double arrow 48, is arranged an adhesive reservoir 50 formed as a pressure chamber which is filled with a dissolved or melted adhesive 52. Arranged in an accumulator 54 is a pressure cylinder 56 with a plunger 58 movable in the direction of double arrow 60 and which projects into the adhesive reservoir 50. According to FIG. 2 a pressure compensation system is formed.

In a simpler embodiment than in FIG. 1, only a fixed stop 22 and a stop positionable according to the stack thickness, corresponding to the retainer 26, are provided. The adhesive discharge system 15 shown in FIG. 2 with a pressure compensation system for adhesive application shows the basic principle of the present invention. The slot 46 communicating with the adhesive 52 is closed.

When stacked printed products 10 (FIG. 1) are guided along the slip surface 16 extending over an angled introduction ramp 62, the control of the metering shaft 44 on reaching the outlet slot 20 immediately switches into the working position shown in dotted lines, the slot 46 of the metering shaft 44 in this position connects the adhesive reservoir 50 with the outlet slot 20. Immediately after the stacked printed products 10 have left the area of the outlet slot 20, the sensor-controlled electronics initiate the rotation of the metering shaft 44 into the rest position, the adhesive supply to the outlet slot 20 is interrupted.

The pressure loss occurring in the adhesive reservoir 50 by the output of adhesive is compensated automatically as the plunger 58 is pushed correspondingly deeper into the adhesive reservoir 50. The pressure in the adhesive reservoir 50 is determined by the cross-sectional ratio of the pressure cylinder 56 to the plunger 58 and the pressure in a preliminary chamber 64 of the accumulator 54. The pressure in this preliminary chamber is for example in the range from 0.7 to 0.8 bar.

Evidently, the binding process for the stacked printed products 10 can be manual or semi-automatic.

A basic design principle of an adhesive application station 14 as a whole is shown in FIGS. 3 to 5. The functional division into application head 12, adhesive reservoir 50 (pressure chamber) and accumulator 54 is evident. Essential individual elements of the application head 12 are shown individually in FIGS. 6 to 12.

The application head 12 comprises as a carrier a nozzle block 18 formed as a profile or milled or bored from a solid block.

At one end on the nozzle block 18 is attached a fixed stop 22 with a first side guide surface 24. This fixed stop can be positioned within the limits of a short slot 66 without fine adjustment.

A retainer 26 can be positioned over the area of a substantially larger slot 68. On the end of the retainer 26 is formed the second side guide surface 28. On the face of the nozzle block 18 opposite the fixed stop 22 is screwed a guide block 72 which for precise positioning of the retainer 26 holds an adjustment screw 74. This adjustment screw 74 comprises a knurled nut 76 with an adjustment scale 78 which can be structured as a vernier scale. Naturally, further variants of the retainer 26 which are not shown can be automatically positionable with other means known in themselves, for example a linear motor, stepper motor, hydraulic or pneumatic means.

In a corresponding bore of the nozzle block 18 is a metering shaft 44, which with the outlet slot 20 forms the slot nozzle 42 and which can be activated manually or mechanically automated by way of a swivellable lever 80.

The application head 12 is screwed and sealed directly to a separate adhesive reservoir 50 formed as a pressure chamber. A filler nozzle 82 for the adhesive reservoir 50 has an external thread and can therefore be connected directly with a larger interchangeable adhesive reservoir, for example a barrel pump. This guarantees absolute air-tight seal of the adhesive. The prevention of contact of the adhesive with air, which is the aim of the invention, is achieved.

The accumulator 54 is connected with the adhesive reservoir 50 via four spacer pipes 84. FIG. 4 shows a bore 86 for compressed air which comprises the usual connection fittings not shown. The pressure medium is guided into a preliminary chamber (64 in FIG. 2) and acts on a pressure cylinder 56 shown in dotted lines which amplifies the pressure surface-proportional and transfers this by way of a plunger 58 to the adhesive reservoir 50.

Figure 6:
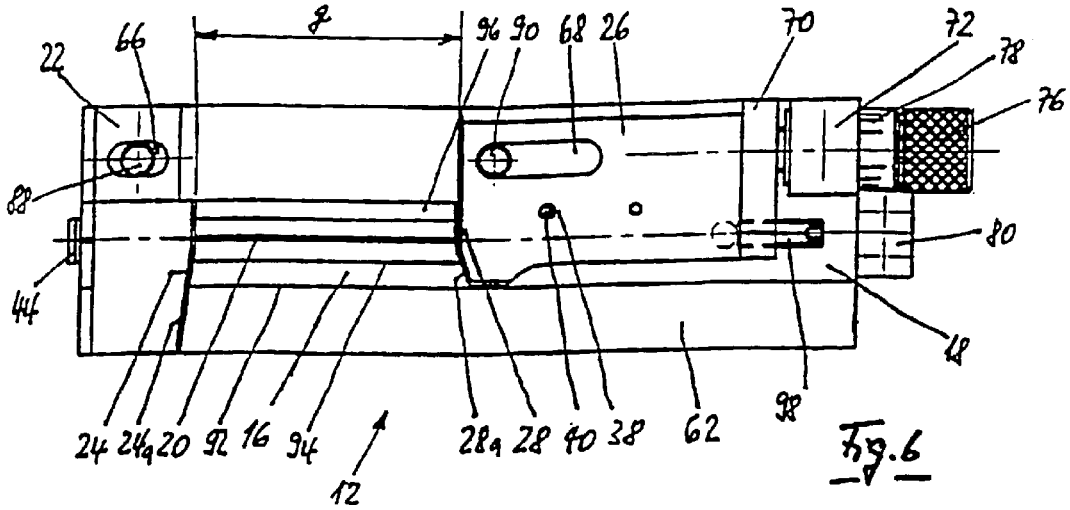
FIG. 6 is an application head in top view.

FIG. 6 shows an application head 12 of an adhesive application station 14 with automatic compensation for the stack thickness of printed products 10 in top view, corresponding substantially—although side inverted—to FIG. 3. For the sake of clarity in particular the fixing bolts for the fixed stop 22 and the retainer 26 are omitted, only the bores 88, 90 for bolts are shown in the slots 66, 68.

The nozzle block 18 according to FIG. 6 in the longitudinal direction not only has the outlet slot 20 for the adhesive but also linear guide elements. The slip surface 16 is angled slightly downwards along an edge 92 and thus forms an angled introduction ramp 62 for easier introduction of the stacked printed products. A first step 94 which is scarcely perceptible and a larger step 96 also serve for simpler fixing of the retainer 26, the fixed stop 22 and the guide block 72.

The width g of the slip surface 16 is set practically to the maximum possible value. It could be enlarged slightly by moving the fixed stop 22. The minimum width g of the slip surface 16 is limited by the length of the slots 66 and in particular 68.

In the retainer 26 can be seen a threaded rod 98. With this the spring force of the slide 32 guided by retainer 26 (FIG. 1) can be set.

Figure 7:
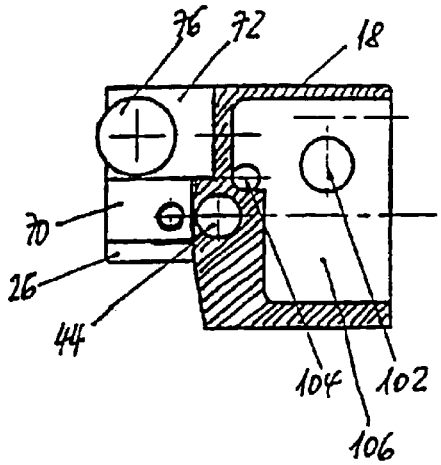
FIG. 7 is a side view of FIG. 6 (from the right)

The side view of FIG. 6 (from the right) shown in FIG. 7 shows hatched the end of the nozzle block 18. Below the guide block 72 with the knurled nut 76 can be seen part of the adjustment plate 70 and, at the bottom, part of the retainer 26.

In the reinforced face of the nozzle block 18 can be seen the swivel-mounted metering shaft 44, its swivel lever (18 in FIG. 4) has been omitted for sake of clarity.

Also, in the nozzle block 18 is held a heating cartridge 102 and a temperature sensor 104 which serve to set the correct adhesive temperature in the application head 12. In a recess 106 can be laid electrical cables, distributors or similar electrical components.

Figure 8:
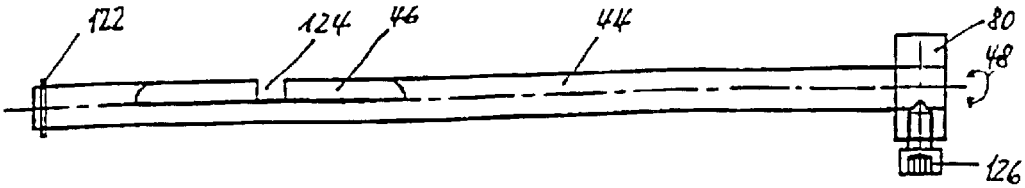
FIG. 8 is a metering device formed as a metering shaft with slot.

A metering shaft 44 shown in FIG. 8 is equipped at one end with a shaft lock 122 and at the other end is mounted a swivel lever 80 for manual or mechanical application of torque. A socket-head bolt 126 which is secured with its tip in a tapered recess of the shaft 44 prevents idle rotation of the lever 80.

In the left-hand area of the metering shaft is cut a linear groove which corresponds in function to a slot 46 (FIG. 2). A radial groove 124 is also provided which ensures the supply of adhesive when the metering shaft is in the working position. The metering shaft 44 can be swivelled into the rest position in the direction of double arrow 128.

Figure 9:
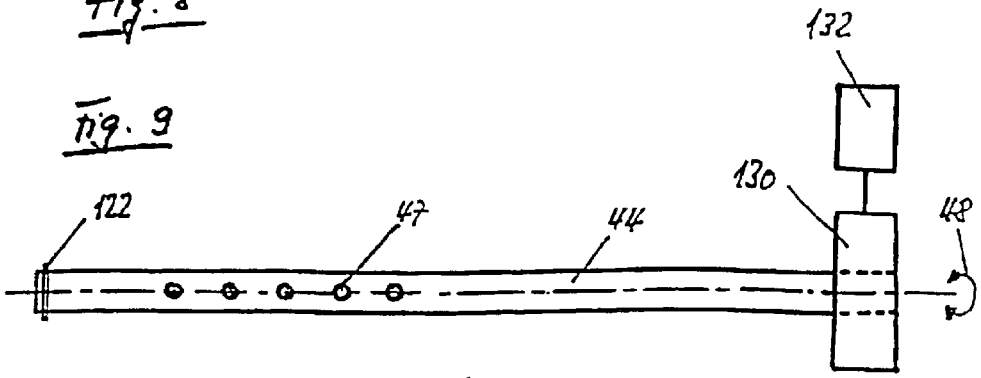
FIG. 9 is a metering device with a longitudinally movable metering body.

FIG. 9 shows a variant of a metering shaft 44. Instead of a slot 46 (FIG. 8) radial bores 47 are formed which are connected by a central channel, not shown. This is supplied by way of a radial groove 124 (FIG. 8) also not shown. In the present case the radial bores 47 are formed circular in cross-section. These can, however, also assume another geometric shape, in particular that of slots. The end of the metering shaft 44 pointing away from the radial bores 47 is held in an actuator 130. This can for example be formed as a stepper motor and swivel the metering shaft 44 in the direction of the double arrow 128 through a previously determined angle and thus adjust from the working position to the rest position and vice versa. The actuator 130 can also be activated by a control unit 132 so that the cross-section of the radial bores 47 is not fully exposed.

Figure 10:
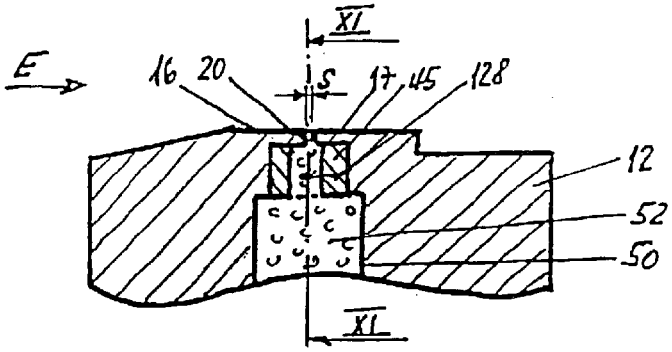
FIG. 10 is a cross-section through a metering device according to FIG. 9.
Figure 11:
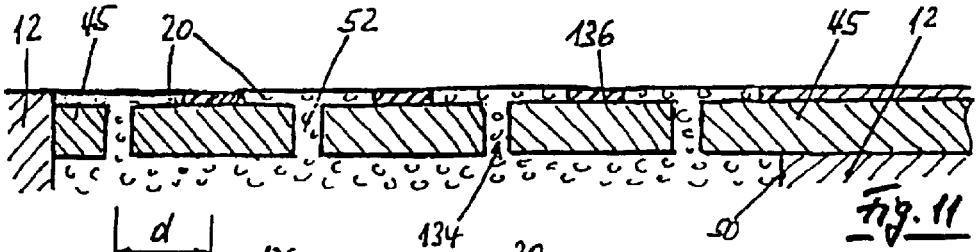
FIG. 11 is a part longitudinal section XI—XI according to FIG. 10 in the working position.
Figure 12:
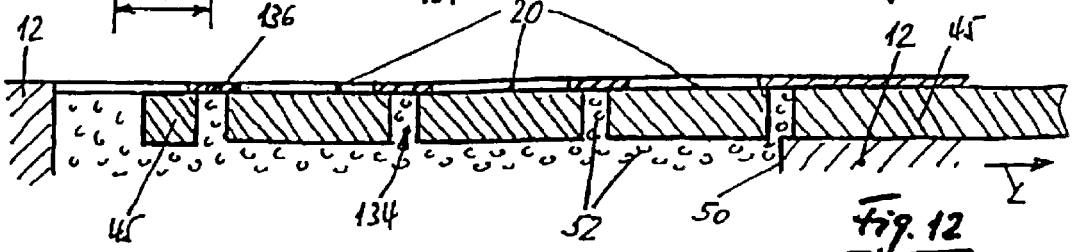
FIG. 12 is a part longitudinal section according to FIG. 11 in the rest position.

FIGS. 10 to 12 show the working method of a longitudinally displaceable metering body 45. This is substantially of rectangular cross-section and as such cannot be swivelled. The outlet opening 20 of width s of 0.1 mm is divided into four part sections, interrupted in each case by a web 136 of the working head 12.

In FIG. 11, the working position, the adhesive 52 can be brought from the adhesive reservoir 50 by way of channels 134 in the longitudinally displaceable metering body 45 into the outlet openings 20.

In the view in FIG. 12 the metering body 45 is moved by distance d in the longitudinal direction L. The channels 134 in the metering body 45 now lie in the area of the webs 136 of the application head 12. Thus, in this variant also the adhesive discharge system 15 (FIG. 2) is sealed immediately adjacent to the outlet openings 20, which is the aim of the invention.

What is claimed is:

1. Adhesive application station (14) for binding stacked printed products (10) by means of a liquid or liquefiable adhesive (52), where the application station (14) comprises an adhesive discharge system (15) comprising:

(1) an application head (12) for the adhesive (52) with a slip surface (16) for the printed products (10), and an application nozzle (42) extending over the entire width (g) of the slip surface (16) with at least one outlet opening (20) for the adhesive;

(2) an adhesive reservoir (50); and (3) means (54, 56, 58, 64) for generating a pressure in the adhesion reservoir (50) for adhesive application, the improvement comprising:

the adhesive discharge system (15) further comprises, immediately adjacent to the outlet opening (20), a metering device (44, 45) which can be sealed by an actuator (130) and which, with the adhesive reservoir (50) formed as a pressure chamber and an integral accumulator (54), forms a pressure compensation system, where the means for generating the pressure in the adhesive reservoir (50) is formed inside the accumulator (54) and arranged proximate the application head (12), whereby after each adhesive discharge an automatic pressure compensation is guaranteed, wherein the metering device (44, 45) is formed as a longitudinally movable metering body (45) and has several longitudinal channels (134), and the outlet openings (20) are formed as slots interrupted by webs (136).

2. Adhesive application station (14) for binding stacked printed products (10) by means of a liquid or liquefiable adhesive (52), where the application station (14) comprises an adhesive discharge system (15) comprising:

(1) an application head (12) for the adhesive (52) with a slip surface (16) for the printed products (10), and an application nozzle (42) extending over the entire width (g) of the slip surface (16) with at least one elongated outlet opening (20) for the adhesive;

(2) an adhesive reservoir (50) that is formed as a pressure chamber; and (3) means (54, 56, 58, 64) for generating a pressure in the adhesive reservoir (50) for adhesive application, the adhesive discharge system (15) further comprises, immediately adjacent to and extending along the outlet opening (20), a metering shaft of a metering device (44, 45), which comprises at least one shaft opening (46, 47) and which, by means of an actuator (130), is rotatable and/or longitudinally movable between a rest position, in which the metering shaft tightly seals the outlet opening (20) and at least one working position, in which the at least one shaft opening (46, 47) connects the adhesive reservoir (50) with the outlet opening (20) wherein the shaft opening (46) of the rotatable metering shaft is a slot that is running diagonally through and extending along the metering shaft.

3. Adhesive application station (14) according to claim 2, wherein the outlet opening (20) consists of an outlet slot (20) extending substantially over the entire width (g) of the slip surface (16) for the printed products (10) or wherein the outlet opening (20) consists of a plurality of outlet openings together extending substantially over the entire width (g) of the slip surface (16) for the printed products (10).

4. Adhesive application station (14) for binding stacked printed products (10) by means of a liquid or liquefiable adhesive (52), where the application station (14) comprises an adhesive discharge system (15) comprising:

(1) an application head (12) for the adhesive (52) with a slip surface (16) for the printed products (10), and an application nozzle (42) extending over the entire width (g) of the slip surface (16) with at least one elongated outlet opening (20) for the adhesive;

(2) an adhesive reservoir (50) that is formed as a pressure chamber; and (3) means (54, 56, 58, 64) for generating a pressure in the adhesive reservoir (50) for adhesive application, the adhesive discharge system (15) further comprises, immediately adjacent to and extending along the outlet opening (20), a metering shaft of a metering device (44, 45), which comprises at least one shaft opening (46, 47) and which, by means of an actuator (130), is rotatable and/or longitudinally movable between a rest position, in which the metering shaft tightly seals the outlet opening (20) and at least one working position, in which the at least one shaft opening (46, 47) connects the adhesive reservoir (50) with the outlet opening (20) wherein the shaft openings (47) of the longitudinally movable metering shaft are formed as channels (134), that are moveable, in the rest position of the metering shaft, under webs (136) that interrupt the outlet opening (20).

5. Adhesive application station (14) according to claim 2 or 4, wherein an metering device (44, 45) and the inside of the outlet opening 20 form a tight-fitting, airtight seal.

6. Adhesive application station (14) according to claim 2 or 4, wherein the outlet opening (20) is between about 0.1 to 5 mm, deep.

7. Adhesive application station (14) according to claim 2 or 4, wherein the means (54, 56, 58, 64) for generating a pressure in the adhesive reservoir (50) are selected from the group consisting of pneumatic means, hydraulic means, electromagnetic means and mechanical means.

8. Adhesive application station (14) according to claim 2 or 4, wherein the means (54, 56, 58, 64) for generating a pressure in the adhesive reservoir (50) comprise an integral accumulator (54) with a preliminary chamber (64) that is set under pressure, preferably in the range from 0.7 to 0.8 bar, by means of a pressure medium, that is guided into the preliminary chamber (64) and that acts on a pressure cylinder (56) that acts by means of a plunger (58) directly on the adhesive (52) in the adhesive reservoir (50) in order to provide automatic compensation for pressure changes in the adhesive reservoir (50) caused by discharge of adhesive.

9. Adhesive application station (14) according to claim 2 or 4, wherein in one of the application head (12) and adhesive reservoir (50) is arranged at least one sensor-controlled heating cartridge (102).

10. Process for operation of an adhesive application station (14) of claim 2 or 4, comprising passing all the adhesive from the reservoir to the outlet opening (20) without contacting the adhesive with air.

* * * * *